US011113941B2

(12) United States Patent
Buchholz et al.

(10) Patent No.: US 11,113,941 B2
(45) Date of Patent: Sep. 7, 2021

(54) AMBIENT LIGHT SENSOR IN A HAZARD DETECTOR AND A METHOD OF USING THE SAME

(71) Applicant: Carrier Corporation, Farmington, CT (US)

(72) Inventors: Matthew J. Buchholz, Canon City, CO (US); Ken Mott, Colorado Springs, CO (US); Bill Chandler, Woodland Park, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 545 days.

(21) Appl. No.: 15/047,784

(22) Filed: Feb. 19, 2016

(65) Prior Publication Data

US 2016/0253886 A1 Sep. 1, 2016

Related U.S. Application Data

(60) Provisional application No. 62/121,802, filed on Feb. 27, 2015.

(51) Int. Cl.
*G08B 17/00* (2006.01)
*G08B 7/06* (2006.01)

(52) U.S. Cl.
CPC ..... *G08B 17/00* (2013.01); *G08B 7/06* (2013.01)

(58) Field of Classification Search
CPC ..... G08B 17/00; G08B 7/06
See application file for complete search history.

(56) References Cited

U.S. PATENT DOCUMENTS

| | | | | |
|---|---|---|---|---|
| 4,202,000 | A | 5/1980 | Carballes | |
| 5,448,082 | A | 9/1995 | Kim | |
| 5,541,704 | A | 7/1996 | Dunsmore | |
| 6,388,399 | B1 * | 5/2002 | Eckel | G01K 1/045 315/312 |
| 6,664,744 | B2 | 12/2003 | Dietz | |
| 7,042,341 | B2 | 5/2006 | McMahon | |
| 7,348,946 | B2 | 3/2008 | Booth, Jr. et al. | |
| 8,203,581 | B2 | 6/2012 | Garcia et al. | |
| 8,258,707 | B2 | 9/2012 | Van Der Veen et al. | |
| 8,330,945 | B2 | 12/2012 | Choi et al. | |
| 8,664,865 | B2 | 3/2014 | Aurongzeb et al. | |
| 2005/0061953 | A1 | 3/2005 | Huiberts et al. | |
| 2010/0244709 | A1 * | 9/2010 | Steiner | G01J 1/0247 315/158 |

(Continued)

OTHER PUBLICATIONS

Analog Devices, Inc., Activity: LED as light sensor [Analog Devices, Wiki].

(Continued)

*Primary Examiner* — James J Yang
(74) *Attorney, Agent, or Firm* — Cantor Colburn LLP

(57) ABSTRACT

A method of operating an alarm device including a processor and a light detector, the method including for operating the light detector to sample a light intensity within an interior space a plurality of times to produce a plurality of light intensity measurements, operating the processor to determine a light intensity value, wherein the light intensity value is based upon the plurality of light intensity measurements, and operating the processor to decide whether a night cycle can be determined based on the light intensity values.

24 Claims, 4 Drawing Sheets

(56) References Cited

U.S. PATENT DOCUMENTS

| | | | | |
|---|---|---|---|---|
| 2012/0006978 | A1 | 1/2012 | Ludwig | |
| 2012/0261079 | A1* | 10/2012 | Chambers | E06B 9/68 160/6 |
| 2012/0319586 | A1 | 12/2012 | Riesebosch | |
| 2013/0112855 | A1 | 5/2013 | McLeod | |
| 2013/0221851 | A1 | 8/2013 | Coates | |
| 2014/0156079 | A1* | 6/2014 | Courtney | E06B 9/32 700/275 |
| 2014/0184083 | A1* | 7/2014 | Pelton | H05B 47/19 315/152 |

OTHER PUBLICATIONS

Forrest M. Mims III, Make: Projects. How to Use LEDs to Detect Light.
Altera, Using LEDs as Light-Level Sensors and Emitters.

* cited by examiner

22

| 24 | 26 | 28 | 30 |
|---|---|---|---|
| *0 | 0 | 1300 | 80 |
| 1 | 0 | 1300 | 80 |
| 2 | 0 | 1300 | 80 |
| 3 | 0 | 150 | 4 |
| 4 | 0 | 160 | 4 |
| 5 | 0 | 1280 | 84 |
| 6 | 0 | 160 | 4 |
| 7 | 0 | 160 | 4 |
| 8 | 0 | 160 | 4 |
| 9 | 0 | 160 | 4 |
| 10 | 0 | 150 | 4 |
| 11 | 0 | 160 | 4 |
| 12 | 0 | 150 | 4 |
| 13 | 0 | 160 | 4 |
| 14 | 0 | 160 | 4 |
| 15 | 0 | 1290 | 80 |
| 16 | 0 | 1280 | 80 |
| 17 | 0 | 1300 | 80 |
| 18 | 0 | 1280 | 80 |
| 19 | 0 | 1300 | 80 |
| 20 | 0 | 1290 | 80 |
| 21 | 0 | 1300 | 80 |
| 22 | 0 | 1295 | 80 |
| 23 | 0 | 1290 | 80 |

TH=495
ALG ON

FIG. 3

AMBIENT LIGHT SENSOR IN A HAZARD DETECTOR AND A METHOD OF USING THE SAME

CROSS REFERENCE TO RELATED APPLICATIONS

The present application is related to, and claims the priority benefit of, U.S. Provisional Patent Application Ser. No. 62/121,802 filed Feb. 27, 2015, the contents of which are hereby incorporated in their entirety into the present disclosure.

TECHNICAL FIELD OF THE DISCLOSED EMBODIMENTS

The presently disclosed embodiments are generally related to devices configured to detect a hazard condition and sound an alarm, such as smoke detectors and carbon monoxide detectors, and more particularly, to an ambient light sensor and a method of using the same.

BACKGROUND OF THE DISCLOSED EMBODIMENTS

Hazard detectors, such as and not limited to smoke alarms and carbon monoxide detectors, are utilized for detecting and warning the inhabitants of a home or other occupied locations of the existence of a hazardous condition. While the detectors are very effective at notifying individuals of the possible existence of the hazardous condition, certain types of other status indications may often be very annoying to a user. These alarms indications may be triggered, for example, by a low battery (i.e., the "low battery chirp"). The hazard detector may also feature a display that illuminates a status of the device. The intensity of the display may also create an unwanted condition for the user.

Accordingly, there exists a need for an efficient, effective and value added hazard detector to better control these unwanted conditions to increase the satisfaction of the user.

SUMMARY OF THE DISCLOSED EMBODIMENTS

In one aspect, a hazard detector is provided. The hazard detector includes a processor in communication with a memory disposed within a housing. One or more programs are stored in memory and the programs are configured to be executed by the processor to perform the method described herein.

The hazard detector further includes a light detector in communication with the processor. The light detector is configured to measure an intensity of received light. The hazard detector further includes a signaling device in communication with the processor. The signaling device is configured to provide an audible and/or visual signal.

In one aspect, the method includes the step of operating the light detector to sample a light intensity within an enclosed space a plurality of times to produce a plurality of light intensity measurements.

The method further includes the step of operating the processor to determine a light intensity value for a first pre-determined interval, wherein the light intensity value is based upon the plurality of light intensity measurements. In an embodiment, the light intensity value comprises a running average of the plurality of light intensity measurements. In one embodiment, the first pre-determined interval is adjustable. In another embodiment, the first pre-determined interval is less than or equal to approximately one hour.

In an embodiment, the method further includes the step of operating the processor to record each light intensity value in the memory. The method further includes the step of operating the processor to decide whether a night cycle can be determined based on the light intensity values. In an embodiment, creating a night cycle includes the step of determining whether a difference between a highest light intensity value ("HLIV") and a lowest light intensity value ("LLIV") is greater than or equal to a minimum light intensity threshold. In an embodiment, the minimum light threshold is adjustable. In another embodiment, the minimum light threshold is less than or equal to a light detector output of approximately 100 millivolts (mV).

If the difference between the HLIV and the LLIV is greater than the minimum light threshold, the method proceeds to the step of determining a start time and an end time of the night cycle based on a darkness threshold. In one embodiment, the darkness threshold is calculated as the LLIV plus a percentage of the difference between the highest light intensity value HLIV and the LLIV. If the difference between the HLIV and the LLIV is less than the minimum light threshold, the method ends and a night cycle may not be determined.

The step of determining a start time and an end time of the night cycle based on a darkness threshold includes the step of determining whether a difference between the end time and the start time is less than or equal to a pre-determined darkness duration. In one embodiment, the pre-determined darkness duration is adjustable. In another embodiment, the pre-determined darkness duration is greater than or equal to approximately 6 continuous hours.

If the difference between the end time and the start time is greater than the darkness duration, the method proceeds to the step of determining whether a light period occurs during the night cycle. In an embodiment, the light period includes a period of time during which a light intensity value is greater than the darkness threshold. If a light period occurs during a night cycle, the method proceeds to the step of determining whether the light period is less than or equal to a pre-determined light period threshold. In an embodiment, the pre-determined light period threshold is adjustable. In another embodiment, the pre-determined light period threshold is less than or equal to approximately 3 continuous hours. If the light period is less or equal to than the pre-determined light period threshold, the light period is filtered out in the determination of the night cycle. If the light period is greater than the pre-determined light period threshold, the light period is not filtered out in the determination of the night cycle.

In an embodiment, the method further includes the step of operating the processor to adjust an operation of a signaling device during the night cycle. In an embodiment, the signaling device comprises at least one of a digital display, a speaker, and a night light.

BRIEF DESCRIPTION OF DRAWINGS

FIG. 3 illustrates a diagram of a data structure according to at least one embodiment of the present disclosure.

DETAILED DESCRIPTION OF THE DISCLOSED EMBODIMENTS

Figure 1:
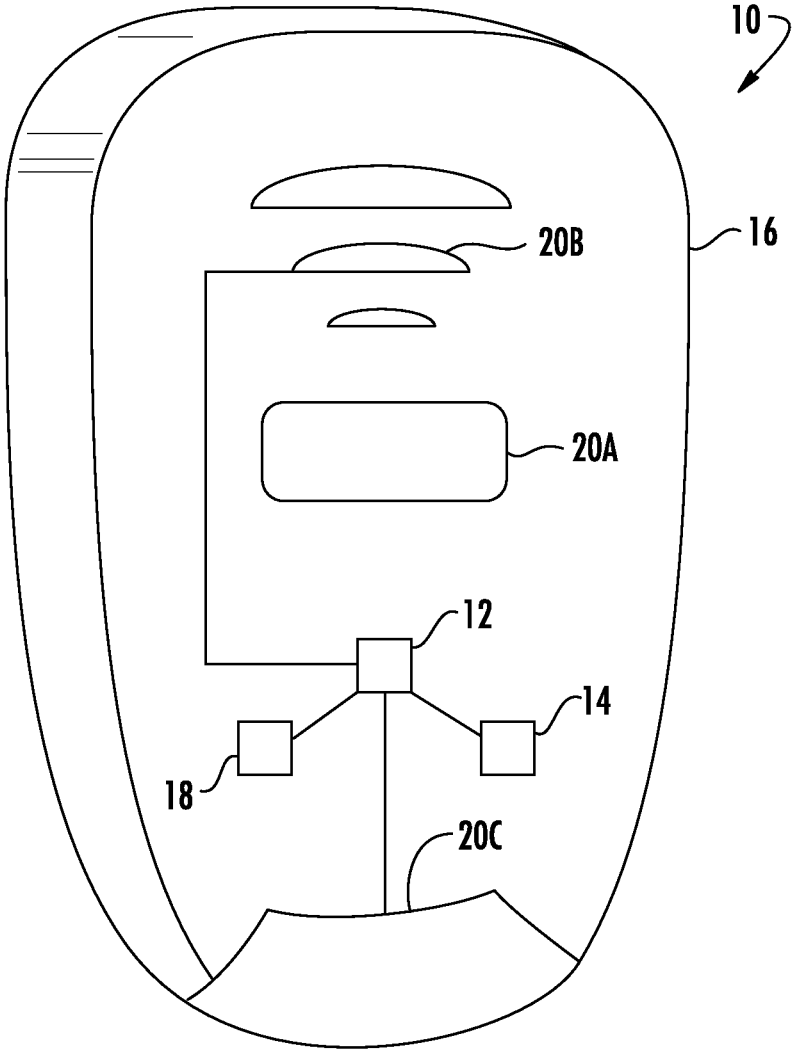
FIG. 1 illustrates a schematic block diagram of a hazard detector according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a hazard detector, for example, a smoke or a carbon monoxide detector to name a couple of non-limiting examples, generally indicated at 10. It will be appreciated that the hazard detector 10 is placed within an interior space (not shown) to monitor hazardous conditions therein. The hazard detector 10 includes a processor 12 in communication with a memory 14 disposed within a housing 16. Memory 14 may include high-speed random access memory, non-volatile memory, such as one or more magnetic disk storage devices, flash memory devices, other non-volatile solid-state memory devices, or as would occur to one of skill in the art. One or more programs are stored in memory 14 and the programs are configured to be executed by the processor 12.

The hazard detector 10 further includes a light detector 18 in communication with the processor 12. The light detector 18 is configured to measure an intensity of received light, for example, ambient light to name one non-limiting example. The hazard detector 10 further includes a signaling device 20 in communication with the processor 12. The signaling device 20 is configured to provide an audible and/or visual signal. For example, the signaling device 20 may include a digital display 20A, speaker 20B, and a night light 20C to name a few non-limiting examples.

Figure 2:
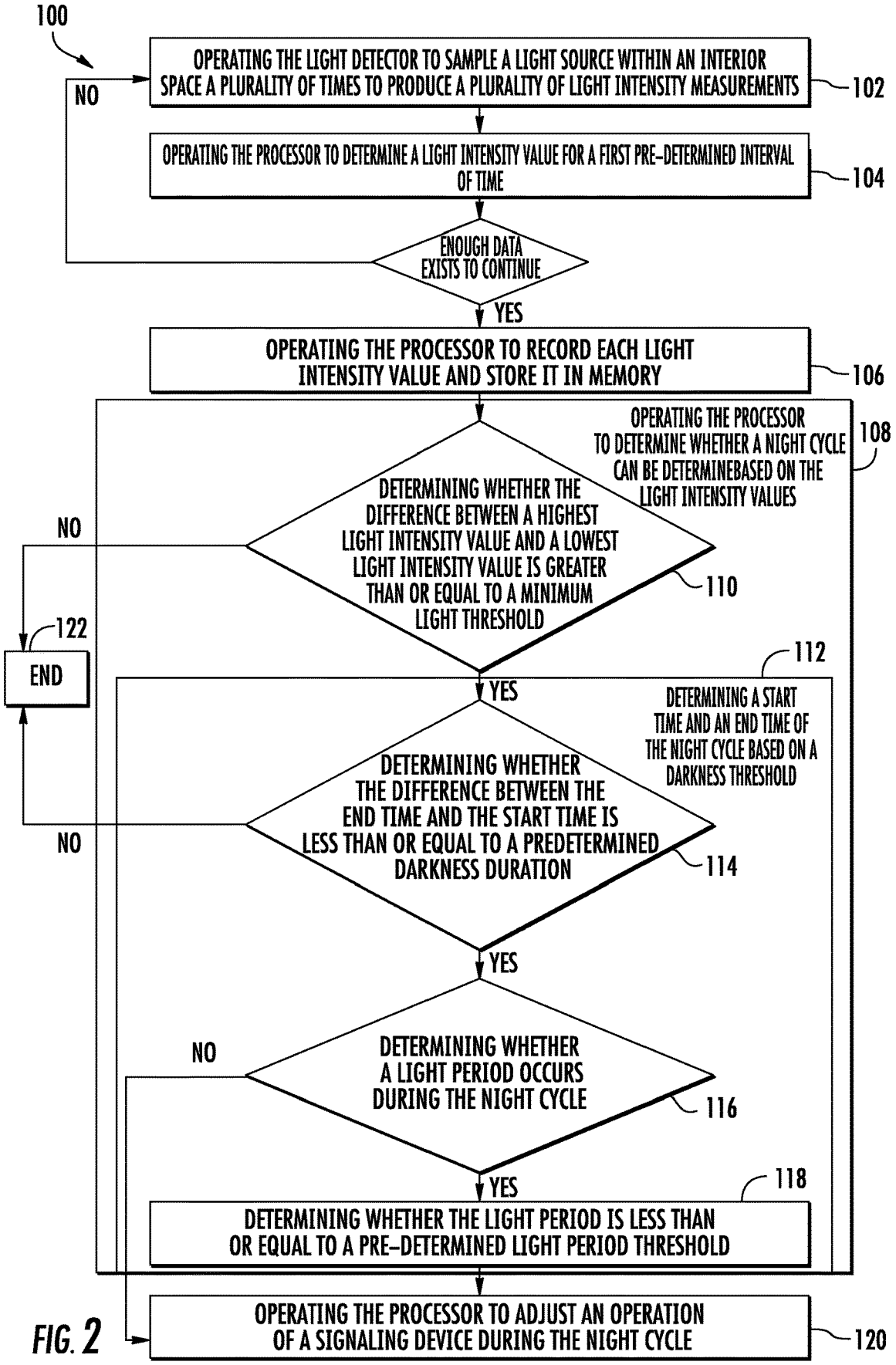
FIG. 2 illustrates a schematic flowchart of a method of operating a hazard detector according to at least one embodiment of the present disclosure.

FIG. 2 illustrates a method of operating a hazard detector 10, the method generally indicated at 100. The method 100 includes step 102 of operating the light detector 18 to sample a light intensity within an enclosed space a plurality of times to produce a plurality of light intensity measurements. In an embodiment, the light detector 18 operates to take a sample at fixed or non-fixed intervals. For example, the light detector 18 takes a sample of the ambient light, at approximately every 5 seconds, within the interior space in which it is contained.

The method 100 further includes step 104 of operating the processor 12 to determine a light intensity value for a first pre-determined interval, wherein the light intensity value is based upon the plurality of light intensity measurements. In an embodiment, the light intensity value comprises a running average of the plurality of light intensity measurements. In an embodiment, the first pre-determined interval is adjustable. In another embodiment, the first pre-determined interval is less than or equal to approximately one hour. It will be appreciated that the first pre-determined interval may be greater than one hour. As an example, the processor 12 takes each light intensity measurement, taken every 5 seconds, and computes the running average of the measurement over the course of one hour. Steps 102 and 104 are repeated a plurality of times to produce sufficient data for the determination of a night cycle.

In an embodiment, the method 100 further includes step 106 of operating the processor 12 to record each light intensity value in the memory 14. For example, the current average light intensity value is recorded into a data structure 22, stored in memory 14, every hour. In the illustrated structure 22, shown in FIG. 3, the first column 24 indicates the light sample position within the structure 22. In this instance, the asterisk indicates a position within the first hour of a twenty four hour cycle. Column 26 records the current twenty four hour sampled measurement of the light source. Column 28 illustrates the previous twenty four hour data sampled measurement of the light source. Column 30 illustrates the previous sampled data that has been analyzed to represent the decision on whether the data within that hour is a night or a light hour (e.g. 80 hex represents that bit 7 is set as a light hour, while 04 or 84 hex represents that bit 3 is set as a night hour). The TH=495 output indicates that the darkness threshold for the present location of the alarm device 10 has been set to 495 millivolts based on the analysis of the data structure 22. The ALG ON output indicates that the alarm device 10 was able to determine a valid night cycle based on the analysis of the data structure 22.

The method 100 further includes step 108 of operating the processor 12 to decide whether a night cycle can be determined based on the light intensity values. In an embodiment, creating a night cycle includes the step 110 of determining whether a difference between a highest light intensity value (HLIV) and a lowest light intensity value (LLIV) is greater than or equal to a minimum light threshold. In an embodiment, the minimum light threshold is adjustable. In another embodiment, the minimum light threshold value is less than or equal to a light detector 18 output of approximately 100 millivolts (mV). It will be appreciated that the minimum light threshold may be greater than a light detector 18 output of 100 millivolts.

Figure 4:
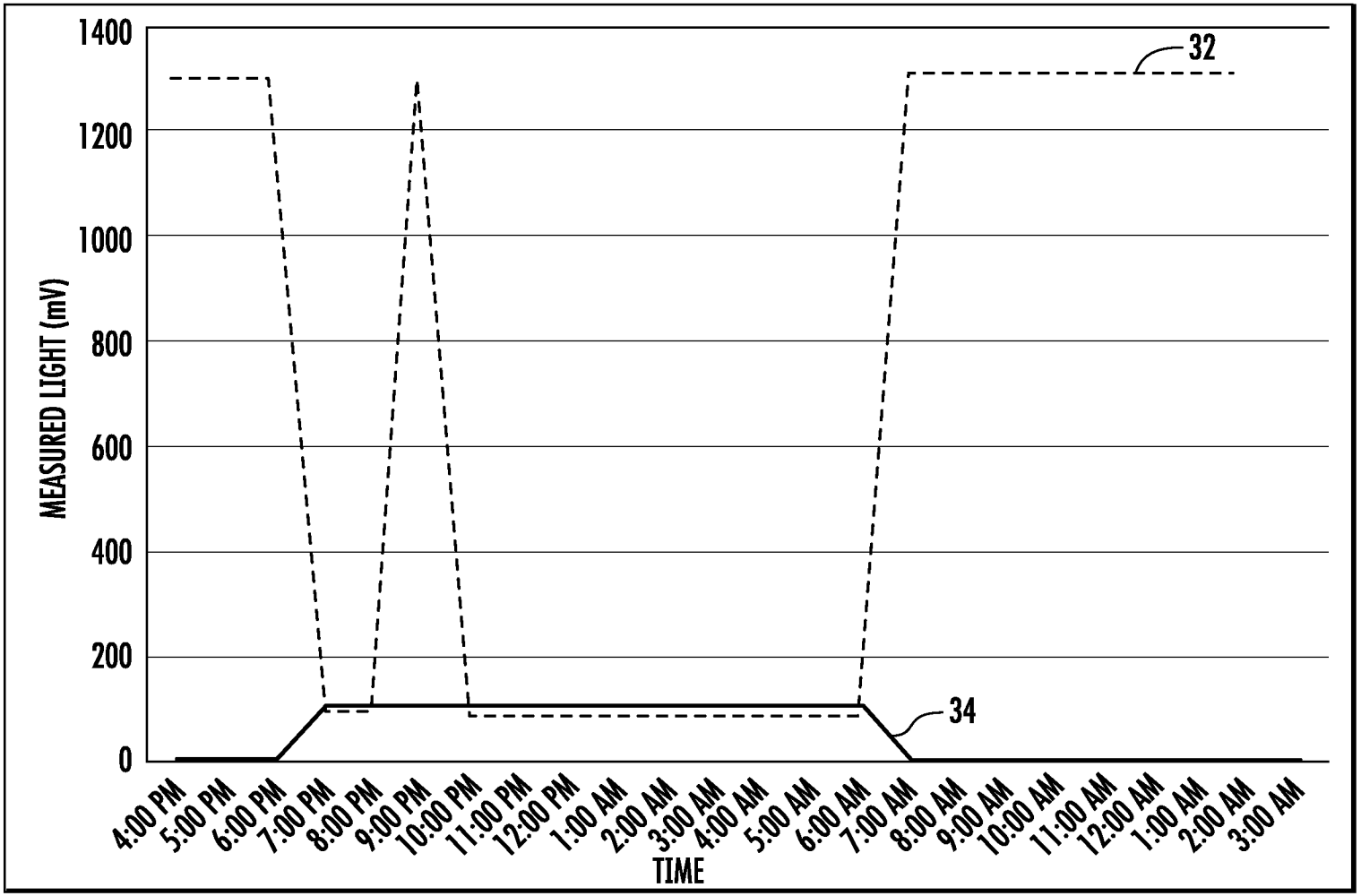
FIG. 4 illustrates a graph of light intensity values over time according to at least one embodiment of the present disclosure.

For example, after data has been gathered for at least 24 hours, the data within structure 22 is analyzed. The processor 12 determines the difference between the highest light intensity value and the lowest light intensity value, as illustrated in the embodiment of FIG. 4. If the difference between the highest light intensity value (e.g. approximately 1300 mV) and the lowest light intensity value (e.g. approximately 150 millivolts) is greater than the minimum light threshold (e.g. 1150 millivolts>100 millivolts), the method proceeds to step 112 of determining a start time and an end time of the night cycle based on a darkness threshold. In one embodiment, the darkness threshold is calculated as the lowest light intensity value (LLIV) plus a percentage of the difference between a highest light intensity value (HLIV) and a lowest light intensity value (LLIV). For example, the darkness threshold may be established by the formula:

$$\text{Darkness Threshold}=[N\times(\text{HLIV}-\text{LLIV})]+\text{LLIV},\quad \text{wherein } 0\leq N\leq 1.$$

It will be appreciated that the darkness threshold may be determined by any suitable difference between the highest and lowest light intensity value as suitable for the device 10. If the delta between the highest light intensity and the lowest light intensity value is less than the minimum light threshold, the method ends at step 122 and a night cycle may not be determined.

Step 112 in this embodiment includes the step 114 of determining whether the difference between the end time and the start time is less than or equal to a predetermined darkness duration. In one embodiment, the predetermined darkness duration is adjustable. In another embodiment, the predetermined darkness threshold is greater than or equal to approximately 6 continuous hours. It will be appreciated that the predetermined darkness duration may be less than 6 continuous hours.

For example, with continued reference to FIG. 4, the processor 12 analyzes the measured light values 32, and determines the darkness threshold to be approximately 495 mV (0.3×(1300 mV−150 mV)+150 mV=495 mV). Therefore, in order to determine a start time of the night cycle, the processor 12 looks for any time period within the structure 22 that has a light intensity value below 495 mV. In order to determine an end time of the night cycle, the processor 12 looks for any time period within the structure 22 that has a light intensity value above 495 mV. Noting that the x-axis in FIG. 4 is for reference only (no clock information is in the processor or detector), starting with the data 32 at the left of the graph in FIG. 4, the processor 12 determines a first start time at approximately 7:00 pm (where the data 32 drops below 495 mV) and a first end time at approximately 9:00 pm (where the data 32 rises above 495 mV). As a result, the difference between the first end time and the first start time (approximately 2 hours) is less than the predetermined darkness duration (6 continuous hours); thus, these data points alone cannot be used to determine a night cycle.

The processor 12 analyzes the next instance where the light intensity value is below 495 mV. The processor 12 determines a second start time at approximately 10:00 pm and a second end time at approximately 6:00 am. As a result, the difference between the second end time and the second start time (approximately 8 continuous hours) is greater than the predetermined darkness duration (6 continuous hours). As such, the method 100 may continue in establishing the night cycle. It will be appreciated that if the difference between the first end time and the first start time is less than the darkness duration for any given twenty four hour sample, the processor 12 cannot determine a night cycle, and the method ends at step 122.

If the difference between the end time and the start time is greater than the darkness duration, the method proceeds to step 116 of determining whether a light period occurs during the night cycle. In an embodiment, the light period includes a duration of time where a light intensity value is greater than the darkness threshold. For example, with continued reference to FIG. 4, a light period occurs between the hours of 8:00 pm and 10:00 pm as the light intensity value (i.e. approximately 1300 millivolts) is above the darkness threshold (495 mV).

If a light period occurs during a night cycle, the method proceeds to step 118 of determining whether the light period is less than or equal to a predetermined light period threshold. In an embodiment, the predetermined light period threshold is adjustable. In another embodiment, the predetermined less than or equal to approximately 3 continuous hours. It will be appreciated that the pre-determined light period may be greater than approximately 3 continuous hours.

If the light period is less than or equal to the predetermined light period threshold (i.e., a light period does not occur), the light period is filtered out in the determination of the night cycle. If the light period is greater than the pre-determined light period threshold, the light period is not filtered out in the determination of the night cycle. For example, with continued reference to FIG. 4, the duration of the light period occurs between the hours of 8:00 pm and 10:00 pm (i.e. approximately 2 hours). As the duration of the light period is less than the pre-determined light period threshold, the light period is filtered out of the determination of the night cycle to create a single, larger consecutive night period. Based on the embodiment shown in FIG. 4, a night period is established from 7:00 pm to 6:00 am as shown by the curve 34.

In an embodiment, the method 100 further includes the step 120 of operating the processor 12 to adjust an operation of at least one of the signaling devices 20 during the night cycle. For example, the processor 12 may adjust the brightness of the display 20A, reduce the volume of a low battery chirp in signaling device 20B, and/or reduce the brightness of a night light 20C to name a few non-limiting examples.

It will therefore be appreciated that the hazard detector 10 operates to measure a light source to determine a night cycle, and to alter the operation of certain signals to reduce unwanted conditions for the user.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A method of operating a hazard detector, the hazard detector including a processor operably coupled to a light detector, and a memory, the method comprising:

operating the light detector to sample a light intensity within an enclosed space a plurality of times during a first predetermined interval to produce a first plurality of light intensity measurements;

operating the processor to determine a first light intensity value for the first pre-determined interval, wherein the first light intensity value is based upon the first plurality of light intensity measurements produced during the first predetermined interval;

operating the light detector to sample the light intensity within the enclosed space a plurality of times during a second predetermined interval to produce a second plurality of light intensity measurements;

operating the processor to determine a second light intensity value for the second pre-determined interval, wherein the second light intensity value is based upon the second plurality of light intensity measurements produced during the second predetermined interval; and operating the processor to establish a night cycle having a start time associated with the first light intensity value and an end time associated with the second light intensity value;

wherein operating the processor to establish the night cycle comprises determining whether a difference between a highest light intensity value (HLIV) of the first light intensity value and the second light intensity value and a lowest light intensity value (LLIV) of the first light intensity value and the second light intensity value is greater than or equal to a minimum light threshold.

2. The method of claim 1, wherein the first light intensity value comprises a running average of the first plurality of light intensity measurements.

3. The method of claim 2, wherein the first pre-determined interval is adjustable.

4. The method of claim 1, wherein operating the processor to establish the night cycle comprises:

determining the start time and the end time of the night cycle based on a darkness threshold if the difference between the highest light intensity value and the lowest light intensity value is greater than or equal to the minimum light threshold.

5. The method of claim 4, wherein the darkness threshold is calculated as the lowest light intensity value (LLIV) plus a percentage of the difference between the highest light intensity value (HLIV) and the lowest light intensity value (LLIV).

6. The method of claim 4, wherein determining the start time and the end time of the night cycle comprises:

determining whether a difference between the end time and the start time is less than or equal to a predetermined darkness duration;

determining whether a light period occurs during the night cycle; and determining whether the light period is less than or equal to a predetermined light period threshold; and filtering out the light period if the light period is less than or equal to the predetermined light period threshold.

7. The method of claim 6, wherein the pre-determined darkness duration is adjustable.

8. The method of claim 7, wherein the light period comprises a duration of time during which a light intensity value is greater than a predetermined light intensity value.

9. The method of claim 6, wherein the pre-determined light period threshold is adjustable.

10. The method of claim 1, further comprising:

operating the processor to adjust an operation of a signaling device of the hazard detector during the night cycle.

11. The method of claim 10, wherein the signaling device comprises at least one of a digital display, a speaker, or a night light.

12. A hazard detector comprising:

a processor and a memory;

a light detector operably coupled to the processor, the light detector configured to sample a light intensity within an interior space a plurality of times to produce a plurality of light intensity measurements;

one or more programs stored in said memory and configured to be executed by said processor, wherein said programs are configured to:

determine a first light intensity value for a first pre-determined interval, wherein the first light intensity value is based upon a first plurality of the light intensity measurements;

determine a second light intensity value for a second pre-determined interval, wherein the second light intensity value is based upon a second plurality of the light intensity measurements; and establish a night cycle based on a darkness threshold, the first light intensity value, and the second light intensity value, the night cycle having a start time associated with the first light intensity value and an end time associated with the second light intensity value;

wherein the programs are configured to establish the night cycle comprising determining whether a difference between a highest light intensity value (HLIV) of the first light intensity value and the second light intensity value and a lowest light intensity value (LLIV) of the first light intensity value and the second light intensity value is greater than or equal to a minimum light threshold.

13. The hazard detector of claim 12, wherein the first light intensity value comprises a running average of the first plurality of the light intensity measurements.

14. The hazard detector of claim 12, wherein the first pre-determined interval is adjustable.

15. The hazard detector of claim 12, wherein the processor is further configured to:

determine the start time and the end time of the night cycle based on the darkness threshold if the difference between the highest light intensity value and the lowest light intensity value is greater than or equal to the minimum light threshold.

16. The hazard detector of claim 15, wherein the darkness threshold is calculated as the lowest light intensity value (LLIV) plus a percentage of the difference between the highest light intensity value (HLIV) and the lowest light intensity value (LLIV).

17. The hazard detector of claim 15, wherein the further configured to:

determine whether a difference between the end time and the start time is less than or equal to a predetermined darkness duration;

determine whether a light period occurs during the night cycle; and determine whether the light period is less than or equal to a pre-determined light period threshold.

18. The hazard detector of claim 17, wherein the darkness duration is adjustable.

19. The hazard detector of claim 17, wherein the light period comprises a duration of time during which a light intensity value is greater than a predetermined light intensity value.

20. The hazard detector of claim 17, wherein the pre-determined light period is adjustable.

21. The hazard detector of claim 12 further comprising a signaling device operably coupled to the processor, wherein the processor is further configured to adjust an operation of the signaling device during the night cycle.

22. The hazard detector of claim 21, wherein the signaling device comprises at least one of a digital display, a speaker, or a night light.

23. A hazard detector comprising:

a processor;

a light detector operably coupled to the processor, the light detector configured to produce light intensity measurements; and a memory including one or more programs stored in the memory and configured to be executed by the processor, wherein the programs are configured to:

determine a first light intensity value for a first pre-determined interval, wherein the first light intensity value is based upon a first plurality of the light intensity measurements;

determine a second light intensity value for a second pre-determined interval, wherein the second light intensity value is based upon a second plurality of the light intensity measurements;

determine a start time of a night cycle if the first light intensity value is below a darkness threshold;

determine an end time of the night cycle if the second light intensity value is above the darkness threshold;

establish a night cycle having the start time and the end time if the difference between the end time and the start time is greater than or equal to a predetermined darkness duration; and adjust an operation of the hazard detector during the night cycle;

wherein establishing the night cycle comprises determining whether a difference between a highest light intensity value (HLIV) of the first light intensity value and the second light intensity value and a lowest light intensity value (LLIV) of the first light intensity value and the second light intensity value is greater than or equal to a minimum light threshold.

24. The hazard detector of claim 23, wherein the one or more programs are further configured to:

determine if a light period occurs between the start time and the end time; and filter out the light period if the light period is less than or equal to a predetermined light period threshold.

* * * * *